US010226106B2

(12) United States Patent
Postolek

(10) Patent No.: US 10,226,106 B2
(45) Date of Patent: Mar. 12, 2019

(54) LOCKING BUCKLE

(71) Applicant: Filip Postolek, Long Beach, CA (US)

(72) Inventor: Filip Postolek, Long Beach, CA (US)

( * ) Notice: Subject to any disclaimer, the term of this patent is extended or adjusted under 35 U.S.C. 154(b) by 309 days.

(21) Appl. No.: 15/080,772

(22) Filed: Mar. 25, 2016

(65) Prior Publication Data

US 2016/0278487 A1 Sep. 29, 2016

Related U.S. Application Data

(60) Provisional application No. 62/139,397, filed on Mar. 27, 2015.

(51) Int. Cl.
*A44B 11/26* (2006.01)
*A44B 11/25* (2006.01)

(52) U.S. Cl.
CPC ..... *A44B 11/2573* (2013.01); *A44B 11/2542* (2013.01); *A44B 11/266* (2013.01)

(58) Field of Classification Search
CPC ..... A44B 11/2592; A44B 11/266; A44B 11/2542; A44B 11/2573; A44B 11/2519; A44B 11/2515; Y10T 24/45581; Y10T 24/45529; Y10T 70/5009; Y10T 24/45241; Y10T 24/45471; Y10T 24/45257; Y10T 24/45476; Y10T 24/75272; Y10T 24/45524; Y10T 24/45513
See application file for complete search history.

(56) References Cited

U.S. PATENT DOCUMENTS

| | | | | |
|---|---|---|---|---|
| 4,912,950 | A | 4/1990 | Crowle | |
| 5,144,725 | A * | 9/1992 | Krauss | A44B 11/266 24/616 |
| 5,311,649 | A | 5/1994 | Suh | |
| 5,465,472 | A | 11/1995 | Matoba | |
| 5,548,879 | A * | 8/1996 | Wu | A44B 11/263 24/616 |
| 5,774,956 | A | 7/1998 | French et al. | |
| 5,933,925 | A | 8/1999 | Anscher et al. | |
| 6,138,330 | A | 10/2000 | Galbreath | |
| 6,145,172 | A | 11/2000 | Bourdon | |
| 6,560,830 | B1 * | 5/2003 | Chi | A44B 11/266 24/616 |
| 6,871,517 | B2 | 3/2005 | Bonelli et al. | |

(Continued)

*Primary Examiner* — Jack W Lavinder
(74) *Attorney, Agent, or Firm* — King & Schickli, PLLC

(57) ABSTRACT

A locking buckle is formed of a male member with one or more flexible portions having a first position and a second position, and a female member adapted for receiving the flexible portions in the first position and allowing the one or more flexible portions to assume the second position to form a secure engagement with the male member. A rotatable member includes a periphery adapted for tactile engagement, the movable member preventing movement of the one or more flexible portions to the first position in a locked condition and allowing movement of the one or more flexible portions in an unlocked condition. A retainer retains the rotatable member in an opening of the female member. The male member may engage and move the rotatable member from the locked condition to the unlocked condition when inserted into the female member, and a detent may control the movement of the rotatable member. Related methods are disclosed.

19 Claims, 8 Drawing Sheets

(56) References Cited

U.S. PATENT DOCUMENTS

Figures 1, 1A, 1B, 1C, 1D, 1E, 1F:
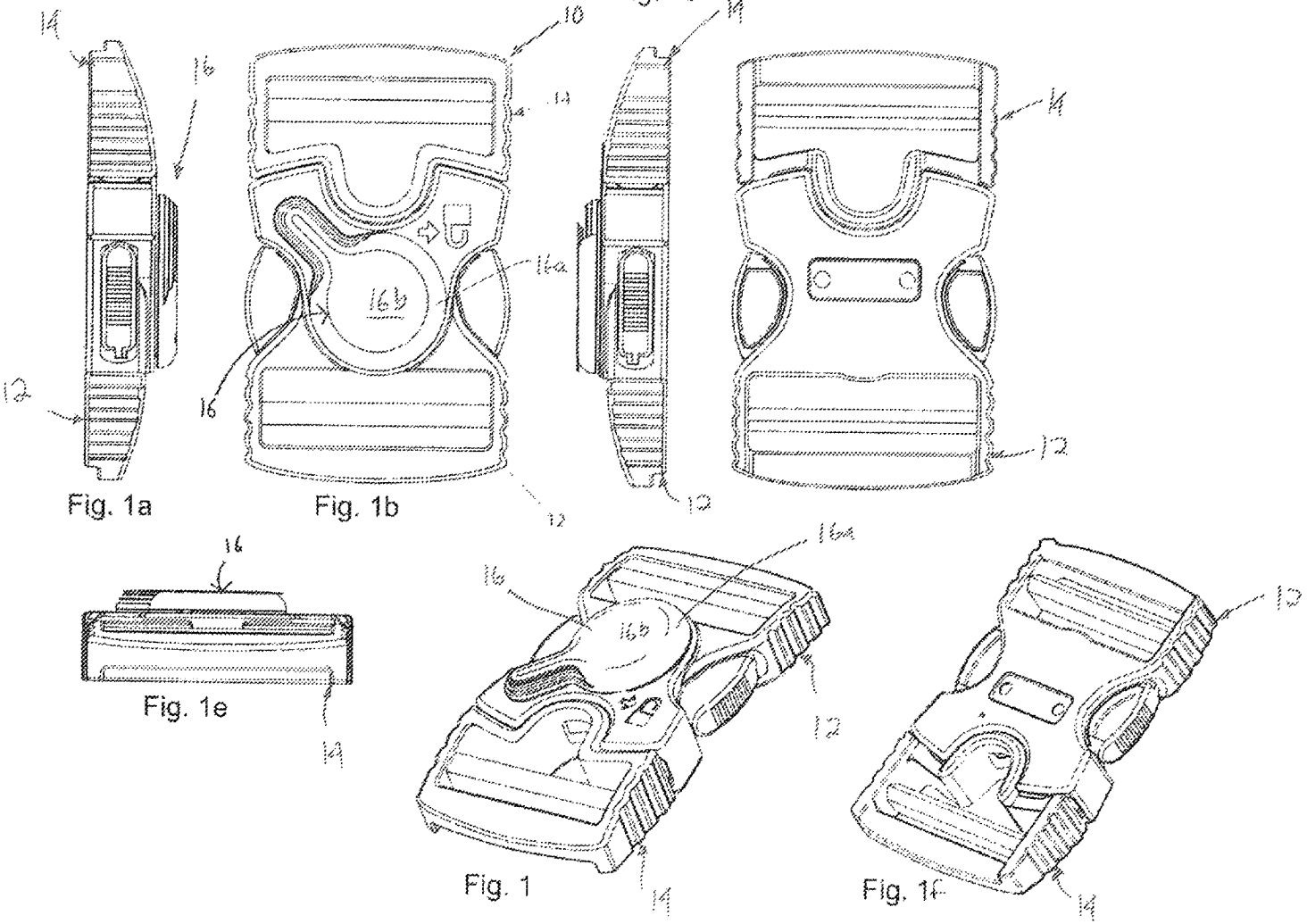

| | | | | |
|---|---|---|---|---|
| 7,150,082 | B2 | 12/2006 | Beletsky | |
| 7,181,936 | B2 | 2/2007 | Christensen et al. | |
| 7,219,406 | B2 | 5/2007 | Chui et al. | |
| 7,350,277 | B1 * | 4/2008 | Canfield | A44B 11/253 24/634 |
| 7,725,993 | B1 | 6/2010 | Giampavolo | |
| 8,176,605 | B2 * | 5/2012 | Mok | A44B 11/266 24/613 |
| 9,032,767 | B2 | 5/2015 | Takahashi | |
| 2007/0181404 | A1 * | 8/2007 | Cash, III | B65G 15/42 198/698 |

* cited by examiner

LOCKING BUCKLE

This patent application claims the benefit of U.S. Provisional Patent Application Ser. No. 62/139,397, the disclosure of which is incorporated herein by reference.

TECHNICAL FIELD

This application relates generally to a buckle, such as for forming a closure or securing two parts together and, in particular, to such a buckle having a locking function.

BACKGROUND OF THE INVENTION

A locking buckle of a known type includes a male part with flexible portions, or "prongs," for being inserted into a female part to form a locking engagement. While the locking engagement is desirable, it is not necessarily secure in the typical arrangement, since it relies in part upon the flexibility of the materials used in order to work. Consequently, over time and perhaps as a result of laxity, the buckle could be inadvertently released, such as through mere jostling. Such buckles are sometimes used in situations where the separation of the parts could have significant consequences, and the inadvertent release is thus undesirable.

Past locking buckles suffer from several limitations. Some proposals use a removable key to perform the locking function, but loss of the key is always a concern, and would render the buckle inoperative. Others include parts for performing the locking function that are difficult to manipulate, requiring fine motor skills to operate, and typically provide no surface for receiving a logo, indicia, or the like. There is also no provision for automatically unlocking the buckle if the locking member or like member is initially in a locked condition prior to insertion of the male part, which may create problems in achieving the connection in an expedient manner.

Accordingly, a need is identified for a solution that may address any or all of the foregoing limitations, and perhaps others that have yet-to-be discovered. The locking buckle would be easy to assemble and manipulate, and would thus provide a secure, yet fully releasable, locking function.

SUMMARY

According to one aspect of the disclosure, a locking buckle includes a male member including one or more flexible portions having a first position and a second position. A rotatable member including a periphery adapted for tactile engagement, the rotatable member preventing movement of the one or more flexible portions to the first position in a locked condition and allowing movement of the one or more flexible portions in an unlocked condition. A retainer is provided for retaining the rotatable member in the opening of the female member.

In one embodiment, the rotatable member comprises a knob having an upstanding sidewall projecting above the surface of the second member. The portion of the rotatable member may comprise a radially extending projection, such as a lever connected to the sidewall of the rotatable member. The rotatable member may include a substantially planar surface bounded by the sidewall, which may be adapted for receiving a logo or the like, such as by way of label, printing, embossment, or similar marking techniques.

In one embodiment, the rotatable member includes one or more depending projections for preventing movement of the one or more flexible portions to the first position. The female member includes a pair of spaced channels, each for receiving one of the depending projections. A retainer may be provided for retaining the locking member relative to the female member. The rotatable member may be adapted for rotating relative to the female member while retained by the retainer. A detent may also be provided for controlling the movement of the rotatable member relative to the female member.

Optionally, a first flexible portion may be adapted for engaging and rotating the rotatable member from the locked condition to the unlocked condition. A second flexible portion may be adapted for not engaging and rotating the rotatable member on insertion into the female member.

According to a further aspect of the disclosure, a locking buckle comprises a male member including one or more flexible portions having a first position and a second position. A female member is adapted for receiving at least a portion of the one or more flexible portions in the first position and allowing the flexible portions to assume the second position to form a secure engagement with the male member, the female member including a surface having an opening formed therein. A movable member is provided for preventing movement of the one or more flexible portions to the first position in a locked condition and allowing movement of the one or more flexible portions in an unlocked condition. The male member may be adapted for engaging and moving the movable member from the locked condition to the unlocked condition when inserted into the female member.

A first flexible portion of the one or more flexible portions may be adapted for engaging and moving the movable member. Specifically, the first flexible portion may include an extension for engaging the movable member in the locked condition to prevent the first flexible member from moving to the first position. A second flexible portion, if present, may be adapted for not engaging and moving the movable member on insertion into the female part. The movable member may comprise a knob having an upstanding sidewall projecting from a surface of the female member, a radially extending lever connected to the sidewall of the movable member, and a substantially planar central surface.

According to a further aspect of the disclosure, a locking buckle, comprises a male member including one or more flexible portions having a first position and a second position, and a female member adapted for at least partially receiving the one or more flexible portions in the first position and allowing the flexible portions to assume the second position to form a secure engagement with the male member. A rotatable member is adapted for preventing movement of the one or more flexible portions to the first position in a locked condition and allowing movement of the one or more flexible portions in an unlocked condition. A detent is provided for controlling the movement of the rotatable member relative to the female member.

In one embodiment, the detent is connected to the female member, and includes a projection for positioning in a groove formed in the rotatable member. The detent may comprise a flexible finger having a dimple for engaging the rotatable member. The movable member may comprise one or more of a knob having an upstanding sidewall projecting from a surface of the female member, a radially extending lever connected to the sidewall of the movable member, and a substantially planar central surface.

Also disclosed is a method for using a locking buckle including a male member, a female member, and a movable member for connecting or locking the female member and male member together. The method comprises engaging and moving the movable member from a locked condition to an unlocked condition during the insertion of the male member into the female member. The movement may be by way of rotation as the result of the linear movement of the male member into the female member, and such that nothing interferes with the rotation to achieve the desired unlocked condition once the male and female members are securely connected.

BRIEF DESCRIPTION OF THE DRAWING FIGURES

Figures 2, 2A:
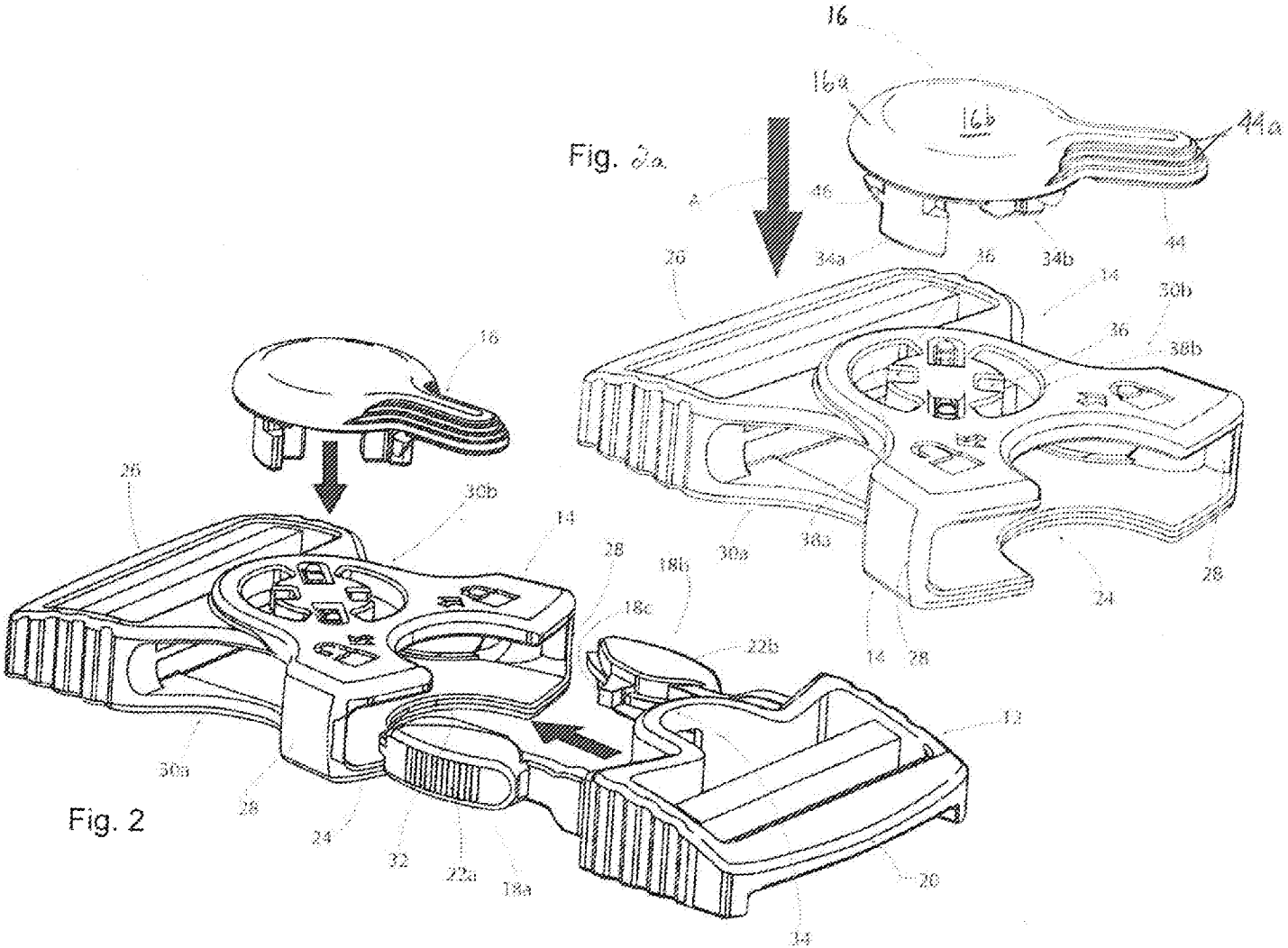
Figure 3B:
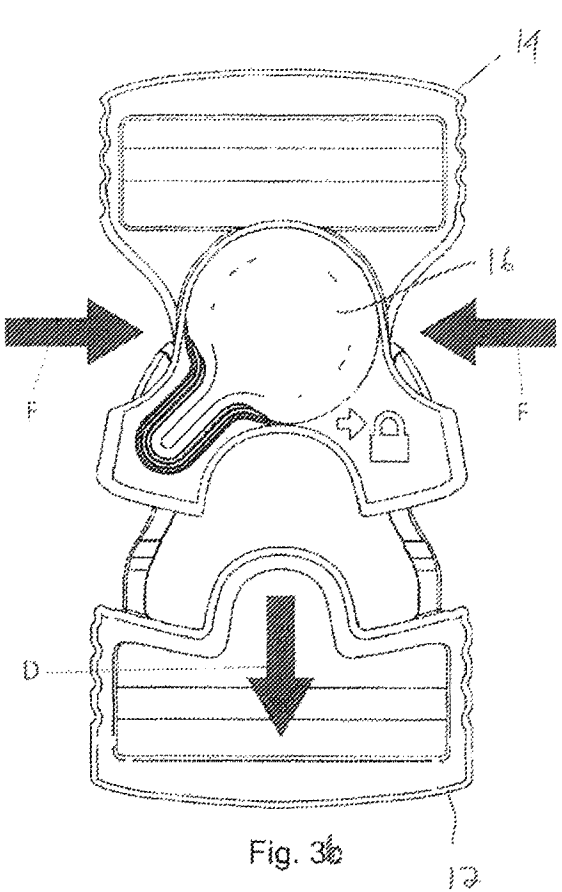
Figure 3A:
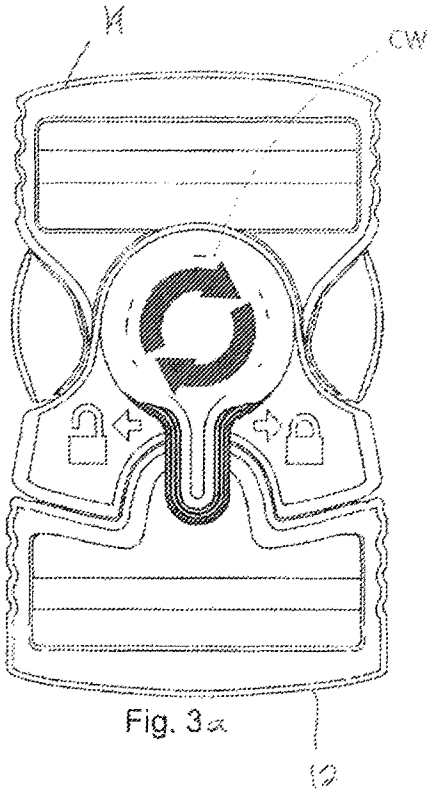
Figure 3:
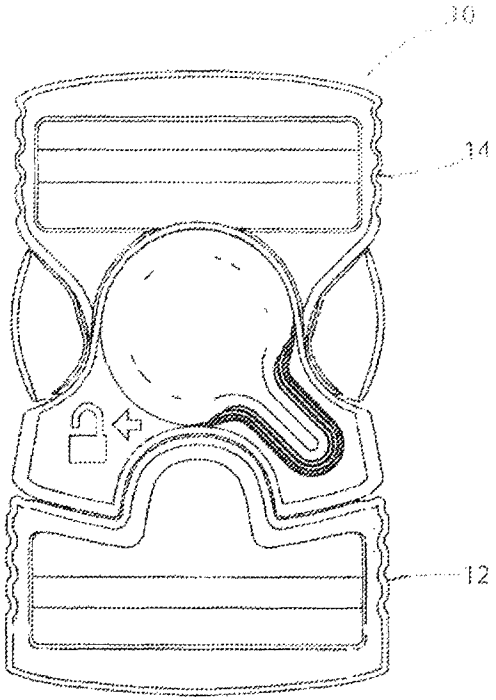
Figure 4B:
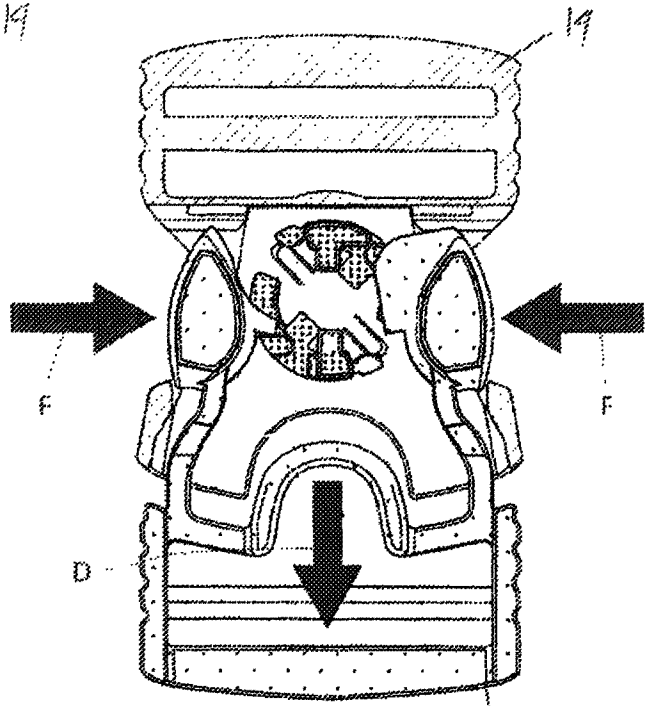
Figure 4A:
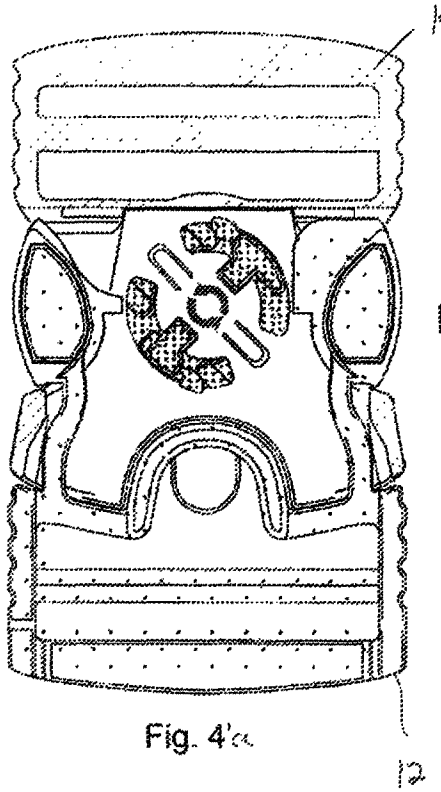
Figure 4:
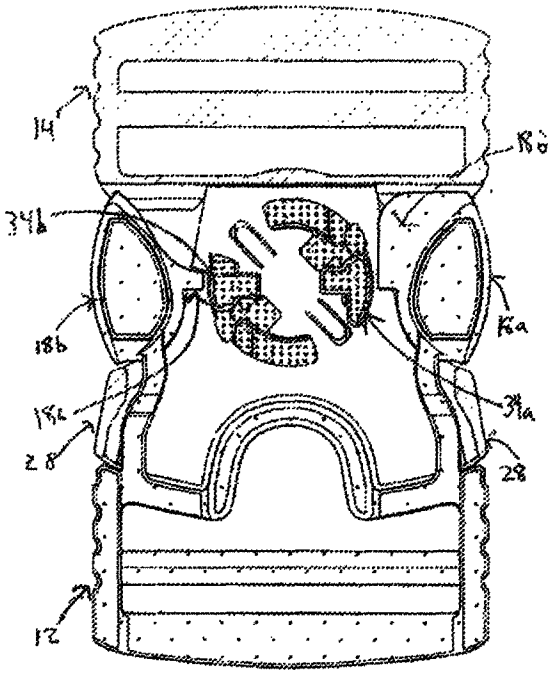
Figure 7A:
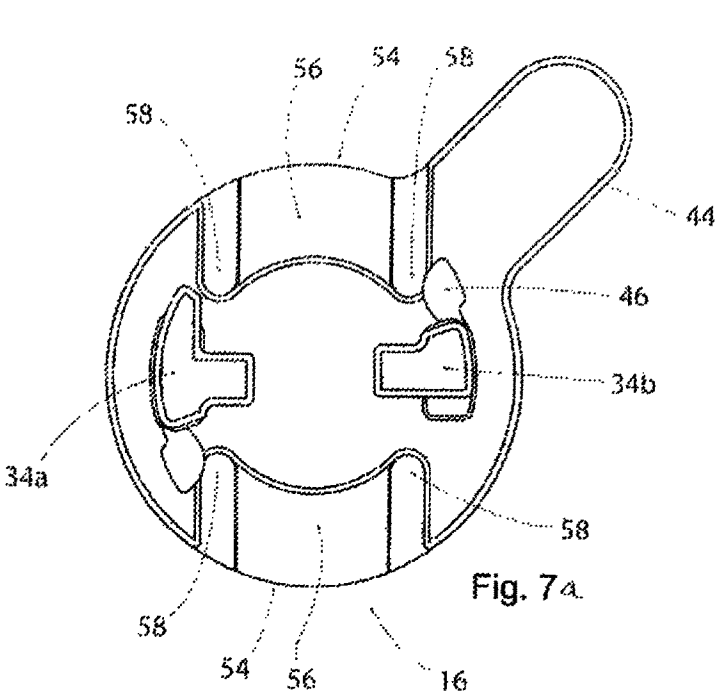
Figure 7:
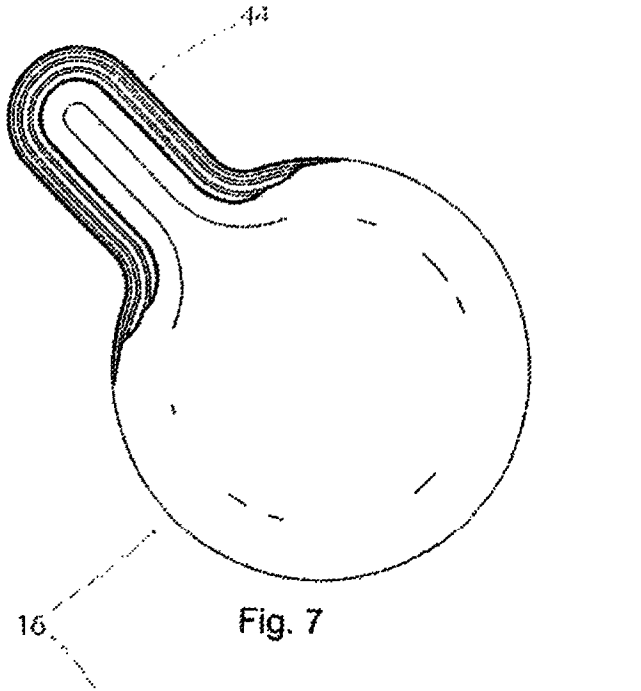
Figure 7C:
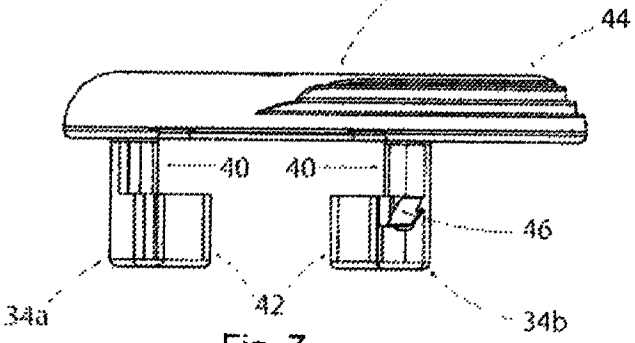
Figure 7B:
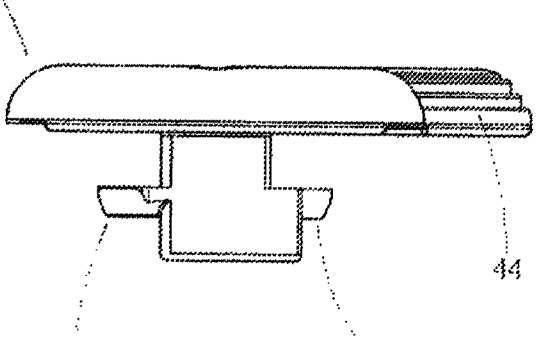
Figure 8B:
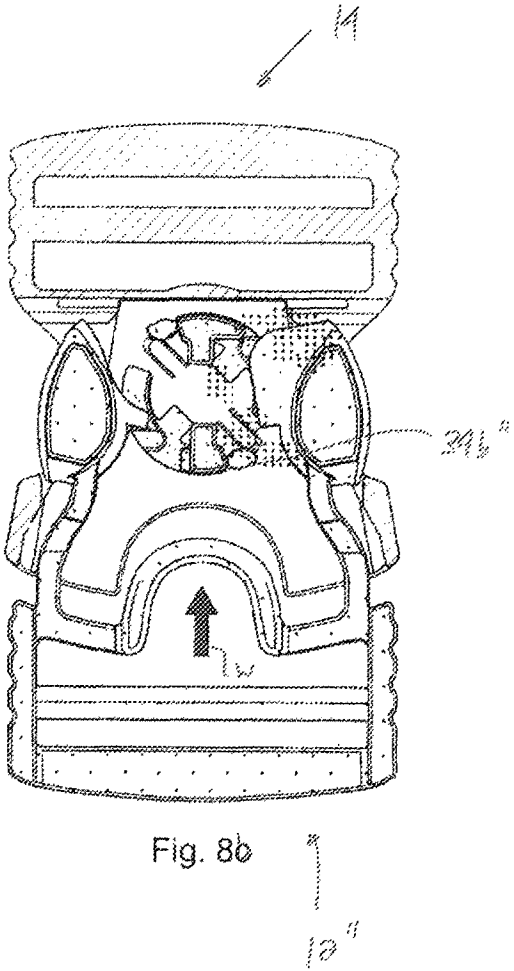
Figure 8A:
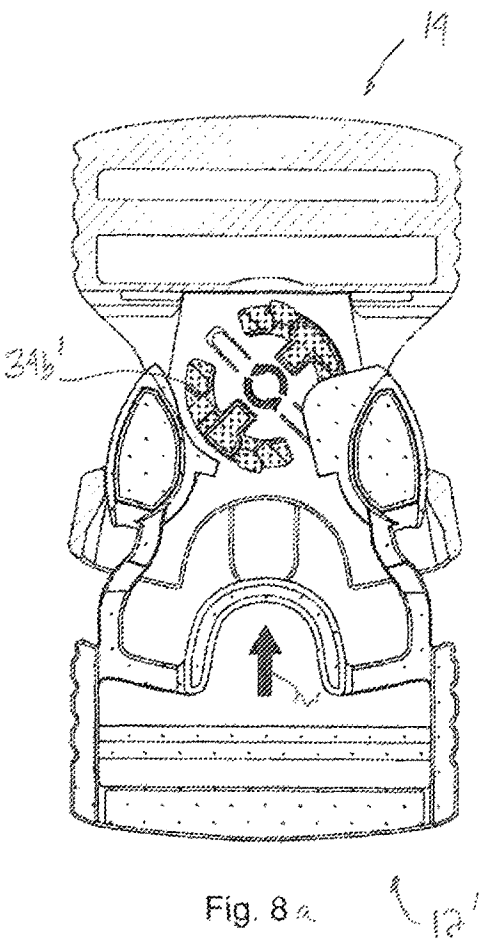
Figure 8:
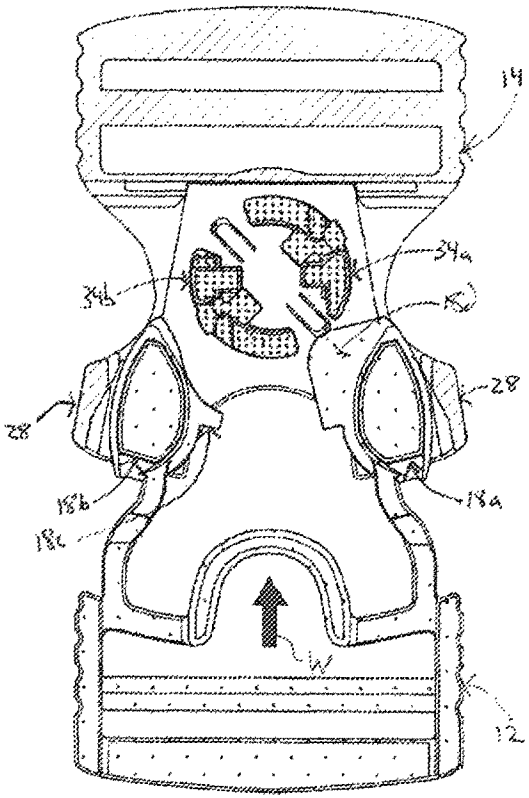

FIG. 1 is a perspective view of a locking buckle according to one embodiment;

FIG. 1*a*-1*f* are various views of the locking buckle of FIG. 1;

FIG. 2 is an exploded view of the buckle of FIG. 1;

FIG. 2*a* is an exploded view of the female member forming part of the buckle;

FIGS. 3, 3*a*, and 3*b* are progressive views illustrating the manner of unlocking the buckle to allow for the male and female members to be separated;

FIGS. 4, 4*a*, and 4*b* are progressive views illustrating the manner of separating the male and female members when the buckle is unlocked;

FIGS. 5, 5*a*, 5*b*, and 5*c* are top, side, front, and rear views of the female member without the locking member;

FIGS. 6, 6*a*, 6*b*, and 6*c* are top, side, front, and rear views of the male member;

FIGS. 7, 7*a*, 7*b*, and 7*c* are top, bottom and different side views of the locking member; and FIGS. 8, 8*a*, and 8*b* are progressive views showing the movement of the locking member to the unlocked condition during insertion of the male member into the female member.

DETAILED DESCRIPTION

Reference is now made to FIGS. 1-1*f*, which illustrate one possible embodiment of a locking buckle 10 according to the present disclosure. In the illustrated embodiment, it can be understood that the buckle 10 comprises a first, male member 12, a second, female member 14, and a locking member 16. As will be more fully understood upon reviewing the description that follows, the locking member 16 is capable of moving to assume a first position where the first and second members 12, 14 may be separated, and a second position where the first and second members are nested and locked together in a secure, but selective, manner.

With reference to FIGS. 2 and 2*a*, it can be understood that the first or male member 12 includes one or more flexible portions, such as first and second flexible projections 18*a*, 18*b* connected to a main body 20 and adapted to be associated with a second, or female member 14. The main body 20 may form a handle or grip and also be adapted for connecting with a structure, such as a strap or the like. The projections 18*a*, 18*b* are adapted to flex relative to a central or longitudinal axis aligned with the direction of insertion. When flexed inwardly, the oversized heads 22*a*, 22*b* of the projections 18*a*, 18*b* may pass into a receptacle 24 formed in the body 26 of the second, female member 14, which may also include a grip or handle and be adapted for connecting with a strap or the like. The heads 22*a*, 22*b* may also include peripheral ridges for gripping purposes.

With continued movement in the longitudinal direction (that is, along axis aligned with arrow X), the head ends 22*a*, 22*b* of the projections 18*a*, 18*b* in this first or depressed condition may pass the corresponding sidewalls 28 and eventually pass into openings 30*a*, 30*b* extending beyond the terminus thereof. Through the resulting spring action, the heads 22*a*, 22*b* may then expand outwardly to a second position and extend into these openings 30*a*, 30*b* and, as a result of engagement with the forward end of sidewalls 28, serve to interlock the male and female members 12, 14. A corresponding receiver 32 on the second or female member 14 may engage a stop 34 on the first or male member 12 to limit the movement and thus ensure that a secure, but releasable connection is established. As can be appreciated, releasing the connection thus established simply involves depressing the heads 22*a*, 22*b* inwardly toward the central axis, such that they may pass back through the receptacle 24.

As noted above, the locking member 16 may be used to provide an enhanced, yet selective level of security and prevent the locking engagement from being reversed, once established. As can be understood from FIGS. 2*b* and 7*c*, the locking member 16 includes one or more depending portions, such as retainers 34*a*, 34*b*. These depending portions may be sized to pass through corresponding, oversized openings 36 (e.g., keyways) forming part of semi-circular or generally arcuate channels 38*a*, 38*b* forming cut-outs in the body 26 of the receptacle 24, which thus providing a guiding function. As can be appreciated, the retainers 34*a*, 34*b* are spaced radially from the center rotational axis of the locking member 16, and thus leave the central surface opposite the upper face of the locking member exposed for engaging a solid, substantially planar portion of the face of the female member 14. This helps to allow for the retainers 34*a*, 34*b* to flex, and also provides a measure of strategic frictional engagement between the locking member 16 and the female member 14.

As perhaps best shown in FIGS. 7*a*-7*d*, the retainers 34*a*, 34*b* include a guide portion 40 and an oversized portion 42. Upon the oversized portion 42 clearing the underside of the body 26 adjacent to the respective channel 38*a* or 38*b*, the locking member 16 may move relative to the body 26. The movement is in a highly controlled, rotary fashion as a result of the interaction between the guide portions 40 and the respective channels 38*a*, 38*b*. Catches 46 depending from the locking member 16, and possibly made flexible, may also serve to capture the locking member against movement in a transverse direction (that is, opposite arrow A in FIG. 2) relative to the second member 14.

As can perhaps best be seen in FIGS. 1*c* and 1*e*, the female member 14 includes a face 14*a*, which may be substantially planar or level (despite the presence of the various openings, logos and the detents, as described below). Locking member 16 may extend above this face 14*a* and rotate relative to it, and thus includes a periphery adapted for ready tactile engagement, such as between two spaced apart fingers for gripping the upwardly projecting outer surface.

Essentially, the locking member 16 forms a knob or handle (such as for a faucet) that can be manually grasped. In one particular example, a projection, such as a lever 44, extends in a radial direction along the surface of the female member from a generally upstanding sidewall 16*a* and may be connected to form part of the periphery of the locking member 16. This projection, such as lever 44 facilitates the relative movement, especially when the buckle 10 is wet, grimy, or frozen, and allows for the rotational movement to be achieved using finger action and the enhanced moment achieved.

To further enhance the gripping action, the lever 44 may be provided with surface variations, such as bumps or ridges 44*a* (FIG. 2*a*), which may thus enhance tactile engagement. The arrangement also leaves the upper portion, or substantially planar face 16*b*, of the locking member 16 free from obstruction. Consequently, it is perfectly adapted to receive a logo, such as on a label, decal, or sticker, or as the result of embossing or molding.

With reference to FIGS. 3*a*-3*c* and 4*a*-4*c* together, the operation of the locking member 16 in securing the first and second members 12, 14 together can be understood. In the locked position, as indicated by FIGS. 3*a* and 4*a*, it can be seen that the oversized portion 42 of each retainer 34*a*, 34*b* is thus positioned in opposition to the oversized head 22*a*, 22*b* of each projection 18*a*, 18*b* (and, in particular, extensions 18*d* and 18*c*, associated with projections 18*a* and 18*b* respectively). Consequently, the inward flexibility required to allow the projections 18*a*, 18*b* to pass the sidewalls 28 cannot occur in a manner sufficient to allow separation of the first and second members 12, 14, and a secure locking engagement results. In contrast, turning the locking member 16 such that the retainers 34*a*, 34*b* are moved away from this blocking condition (by rotating the locking member 16 in a clockwise direction in the figures; note arrow CW in FIG. 3*b*) allows for the normal flexion of the projections 18*a*, 18*b* (see arrows F in FIG. 4*c*) to be achieved such that the sidewalls 28 may be passed and the first and second members 12, 14 separated (in direction D in FIG. 4*b*).

Figure 5B:
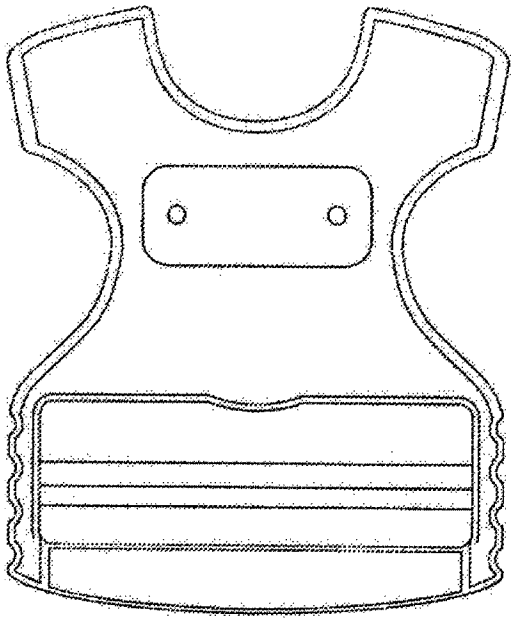
Figure 5A:
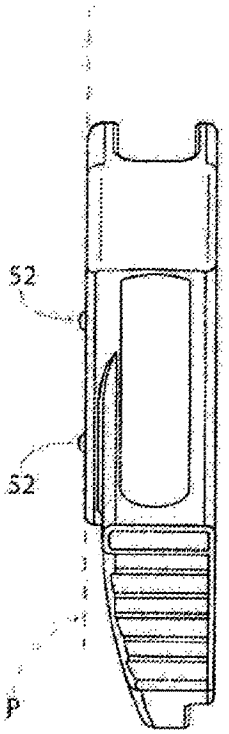
Figure 5:
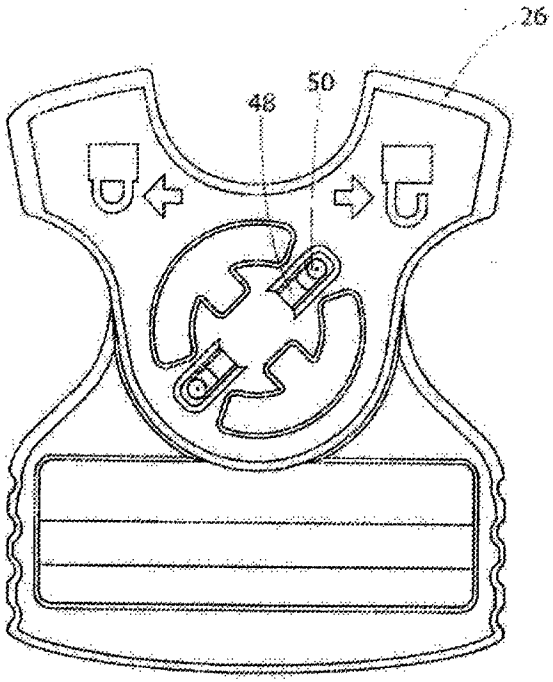
Figure 5C:
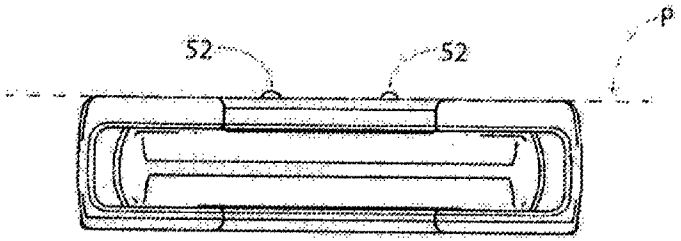
Figure 6B:
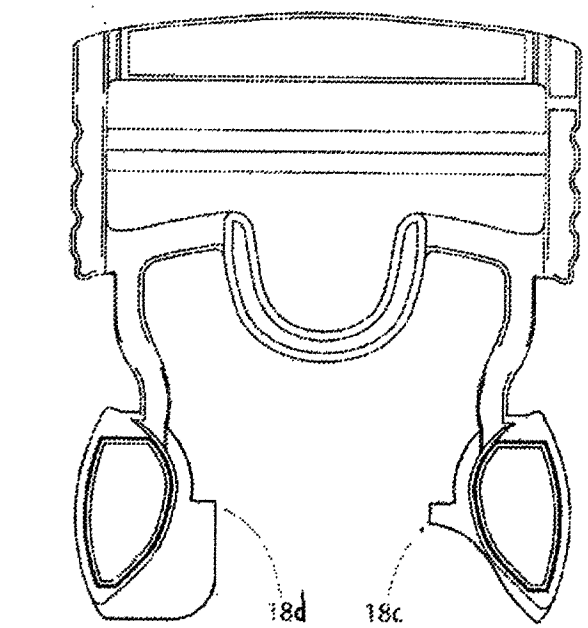
Figure 6A:
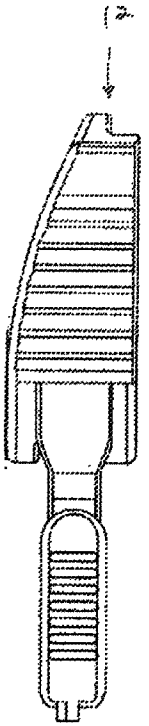
Figure 6:
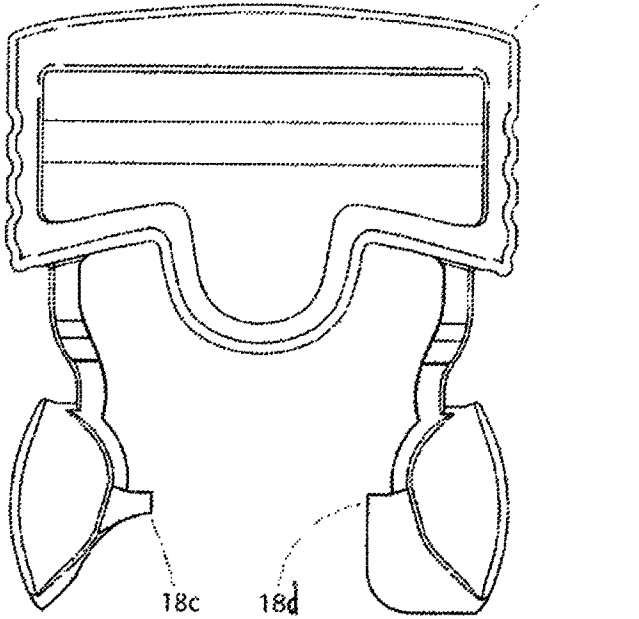
Figure 6C:
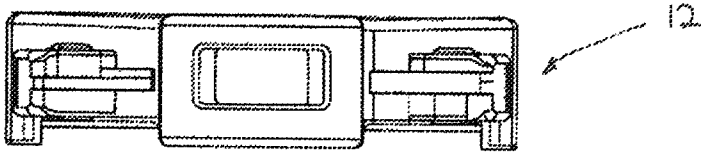

Additional guide and retention structures may also be provided for controlling the movement of the movable locking member 16. For instance, with reference to FIGS. 5-5*d*, it can be understood that flexible members or fingers 48 may be provided in cutouts 50 forming part of the face of the body 26 of the second member 14, and generally coplanar therewith. These members 48 may include upwardly extending projections 52 (as illustrated in FIGS. 5*b* and 5*d*), such as hemispherical bumps, or dimples, that extend above the plane P of the body 26 and engage corresponding grooves 54 formed in the opposing surface of the locking member 16 (as best shown in FIG. 7*b*). The grooves 54 may include a shallow, intermediate portion 56 and deeper end portions 58 into which the projections 52 on the members 48 may naturally extend as a result of the flexibility of the members 48, thus forming a detent. The lower surface of the locking member 16 extending over the upper surface of the female member 14 also provides a measure of frictional engagement to assist in retaining the locking member in the desired (unlocked or locked) position.

Rotation of the locking member 16 thus requires the application of a sufficient manual force to cause the projections 52 to leave the seated position in the deeper end portions 58 and become situated in the shallower portion 56 (which is possible in view of the flexibility of member 48), which may be facilitated through the use of lever 44. The projections 52 then reseat when the rotational movement is complete. In other words, the detent thus formed provides resistance against the rotational movement of the locking member 16. This feature not only provides an added measure of guidance as the locking member 16 is moved or rotated to and fro, but also an additional measure of security that prevents the inadvertent movement of the locking member between the locked and unlocked positions.

According to a further aspect of the disclosure, the locking member 16 may also be automatically moved or rotated, such as from the locked (blocking) position to the unlocked position, upon insertion of the male member 12 into female member 14. As can be appreciated from FIGS. 6*a*, 6*c*, 8*a*, 8*b*, and 8*c*, one of the flexible projections, such as projection 18*d*, may be configured to engage retainer 34*a* when locking member 16 is in a locked position prior to insertion, and then also engage retainer 34*a* to provide the locking condition. Specifically, the extension 18*d* may extend inwardly in an amount (FIGS. 6, 6*b* and 6*c*) sufficient to engage retainer 34*a* and rotate the locking member into an unlocked position when male member 12 is inserted into female member 14 (in a direction illustrated by the arrow W in FIG. 8*a*) and locking member 16 is in a locked position (note positions of depending portion 34*b*, 34*b*', 34*b*" and male member 12, 12', 12"). This allows the male member 12 to be inserted regardless of the position of the locking member 16. The other projection 18*c* does not have a similar amount of projection, and thus avoids any interference with the movement (see FIGS. 8*a* and 8*b*). Indeed, the supporting projection 18*b* and/or member 18*c* may be contoured to accommodate the movement of the locking member 16, such as by having corresponding curved peripheral surfaces.

As can be appreciated from FIGS. 3, 3*a*, and 3*b*, the locked or unlocked condition of the buckle 10 may be illustrated by corresponding image or indicia, such as a conventional lock in an open and closed condition. The images may be placed at the corresponding positions of the handle 44 to allow the user to quickly identify the respective condition of the buckle 10. Arrows may also be depicted to indicate the direction of movement required to achieve the illustrated result.

Having shown and described various embodiments, further adaptations of the apparatuses, methods and systems described herein may be accomplished by appropriate modification by one of ordinary skill in the art without departing from the scope of the disclosure. Several of such potential modifications have been mentioned, and others will be apparent to those skilled in the art. For instance, the examples, embodiments, geometries, materials, dimensions, ratios, steps, and the like discussed above are illustrative and are not required. Moreover, while there is a desire to use two flexible portions or projections to achieve the locking engagement, it could be achieved with only one such structure, and a corresponding arrangement of blocking structures on the movable or rotatable member. Accordingly, the scope of the disclosure should be considered in terms of claims that may be presented, and is understood not to be limited to the details of structure and operation shown and described in the specification and drawings.

The invention claimed is:

1. A locking buckle, comprising:

a male member including one or more flexible portions having a first position and a second position;

a female member adapted for receiving the one or more flexible portions in the first position and allowing the one or more flexible portions to assume the second position to form a secure engagement with the male member, the female member including a surface having an arcuate channel formed therein; and a rotatable member engaging the arcuate channel, the rotatable member preventing movement of the flexible portions to the first position in a locked condition and allowing movement of the flexible portions in an unlocked condition.

2. The buckle of claim 1, wherein the rotatable member comprises a knob having an upstanding sidewall projecting above the surface of the female member.

3. The buckle of claim 1, wherein the rotatable member comprises a radially extending projection connected to the rotatable member.

4. The buckle of claim 1, wherein the rotatable member includes a substantially planar central surface.

5. The buckle of claim 1, wherein the rotatable member includes one or more depending projections for preventing movement of the flexible portions to the first position.

6. The buckle of claim 5, wherein the female member includes a pair of spaced arcuate channels, each for receiving one of the depending projections.

7. The buckle of claim 1, wherein the rotatable member includes an integral retainer.

8. The buckle of claim 7, wherein the rotatable member is adapted for rotating relative to the female member while retained by the retainer.

9. The buckle of claim 1, further including a detent for controlling the movement of the rotatable member relative to the female member.

10. The buckle of claim 1, wherein a first flexible portion is adapted for engaging and rotating the rotatable member from the locked condition to the unlocked condition on insertion of the male member into the female member, and a second flexible portion is adapted for not engaging and rotating the rotatable member on insertion into the female member.

11. A locking buckle, comprising:

a male member including one or more flexible portions having a first position and a second position;

a female member adapted for receiving the one or more flexible portions in the first position and allowing the one or more flexible portions to assume the second position to form a secure engagement with the male member, the female member including a surface having an opening formed therein; and a rotatable member for preventing movement of the one or more flexible portions to the first position in a locked condition and allowing movement of the one or more flexible portions in an unlocked condition;

wherein the male member is adapted for engaging and moving the rotatable member from the locked condition to the unlocked condition when inserted into the female member.

12. The buckle of claim 11, wherein a first flexible portion is adapted for engaging and moving the rotatable member when inserted into the female member.

13. The buckle of claim 12, wherein the first flexible portion includes an extension for engaging the rotatable member in the locked condition to prevent the first flexible member from moving to the first position.

14. The buckle of claim 11, further including a detent for controlling the movement of the rotatable member relative to the female member.

15. The buckle of claim 11, wherein the rotatable member comprises a knob having an upstanding portion projecting above the surface of the female member, the upstanding portion including a radially extending part projecting from the periphery of the upstanding portion and adapted for tactile engagement.

16. The buckle of claim 11, wherein the rotatable member includes spaced depending projections passing through spaced channels in the female member for preventing movement of the flexible portions to the first position in the locked condition, and arranged in the path of at least a portion of the male member in the locked condition.

17. A locking buckle, comprising:

a male member including a pair of flexible portions, each having a first position and a second position;

a female member having a compartment adapted for receiving the flexible portions in the first position and allowing the flexible portions to assume the second position to form a secure engagement with the male member;

a rotatable member adapted for preventing movement of the flexible portions to the first position in a locked condition and allowing movement of the flexible portions in an unlocked condition, the rotatable member including a portion in the compartment of the female member, the portion adapted for being engaged by one of the flexible portions during insertion of the male member into the female member in order to rotate the rotatable member to the unlocked condition.

18. The locking buckle of claim 17, wherein the female member comprises at least one arcuate channel for guiding the portion of the rotatable member in the compartment.

19. The locking buckle of claim 17, wherein one of the flexible projections includes an inwardly directed portion for engaging the portion of the rotatable member to cause the rotation to the unlocked condition upon insertion of the male member into the female member.

* * * * *